US006974028B2

(12) United States Patent
Ford et al.

(10) Patent No.: US 6,974,028 B2
(45) Date of Patent: Dec. 13, 2005

(54) SHIPPING CONTAINER WITH SUPPORT MEMBER FOR MERCHANDISING PLURAL SUSPENDED ITEMS

(75) Inventors: Jonathan Ford, Melrose Park, PA (US); Allan L. Ford, Melrose Park, PA (US)

(73) Assignee: Reborn Products Co., Inc., Bensalem, PA (US)

( * ) Notice: Subject to any disclaimer, the term of this patent is extended or adjusted under 35 U.S.C. 154(b) by 143 days.

(21) Appl. No.: 10/305,451

(22) Filed: Nov. 27, 2002

(65) Prior Publication Data

US 2004/0099547 A1 May 27, 2004

(51) Int. Cl.[7] ..... B65D 85/18; B42F 1/00; B65B 5/10

(52) U.S. Cl. ..... 206/279; 53/475; 206/285; 206/288; 206/291; 206/296; 206/298; 206/526; 211/59.1

(58) Field of Search ..... 206/278–279, 206/284–285, 288–292, 296, 298, 461, 583, 206/526, 764; 211/57.1, 59.1; 53/399, 446, 53/475

(56) References Cited

U.S. PATENT DOCUMENTS

| | | | | | |
|---|---|---|---|---|---|
| 1,836,433 | A | * | 12/1931 | Batts | 206/279 |
| 2,796,977 | A | | 6/1957 | Divine | |
| 2,974,779 | A | * | 3/1961 | Belsinger | 206/279 |
| 3,357,542 | A | * | 12/1967 | Aquino et al. | 206/279 |
| 3,659,704 | A | | 5/1972 | Collura et al. | |
| 3,987,898 | A | | 10/1976 | Crane | |
| 4,098,399 | A | | 7/1978 | Bethune et al. | |
| 4,576,280 | A | | 3/1986 | Dove et al. | |
| 4,693,369 | A | | 9/1987 | Lagin | |
| 4,779,720 | A | | 10/1988 | Mandelbaum | |
| 4,842,131 | A | | 6/1989 | Mandelbaum | |
| 4,944,395 | A | * | 7/1990 | Coursen | 206/288 |
| 5,054,727 | A | * | 10/1991 | Campbell et al. | 248/220.31 |
| 5,249,668 | A | | 10/1993 | Fenton et al. | |
| 5,901,860 | A | * | 5/1999 | Nowicki | 211/59.1 |
| 6,070,747 | A | | 6/2000 | Shea | |
| 6,109,447 | A | * | 8/2000 | Cabana | 206/764 |
| 6,155,415 | A | | 12/2000 | Runyan | |
| 6,199,706 | B1 | | 3/2001 | Shea | |
| 6,202,866 | B1 | | 3/2001 | Shea | |
| 6,786,340 | B2 | * | 9/2004 | Ford et al. | 211/59.1 |
| 2002/0108881 | A1 | * | 8/2002 | Shah | 206/526 |

* cited by examiner

*Primary Examiner*—Bryon P. Gehman
(74) *Attorney, Agent, or Firm*—Caesar, Rivise, Bernstein, Cohen & Pokotilow, Ltd.

(57) ABSTRACT

An assembly for transporting, storing and merchandising plural articles of merchandise. The assembly comprises a shipping container in which a fixture and the articles of merchandise are located. The shipping container includes an outer carton and an inner compartment. The fixture is located within the inner compartment and includes an elongated display member and a bracket. The elongated display member supports the articles of merchandise. The shipping container includes a portion that can be opened to provide access to the bracket to enable the bracket to be connected to the elongated display member while that member is still within the shipping container. The fixture and the shipping carton can then be mounted on any vertically oriented structural member, whereupon the shipping container can be removed leaving the fixture in place with the merchandise suspended from it.

25 Claims, 12 Drawing Sheets

SHIPPING CONTAINER WITH SUPPORT MEMBER FOR MERCHANDISING PLURAL SUSPENDED ITEMS

BACKGROUND OF THE INVENTION

1. Field of the Invention

This invention relates to cartons and more particularly to the combination of a shipping carton and merchandise fixture for attachment to a vertically oriented structural member, such as a conventional slotted upright or standard for shelving, a wire rack, a slat wall, a peg board, etc.

2. Description of Related Art

Various structures for displaying merchandise are commonly found in commercial enterprises and several are the subject of patents. Many of such structures make use of a horizontally disposed member arranged to be mounted on a vertical surface to support, e.g., suspend, merchandise for sale or other purposes. See for example, U.S. Pat. No. 6,202,866 (Shea), U.S. Pat. No. 6,199,706 (Shea) and U.S. Pat. No. 6,070,747 (Shea).

U.S. Pat. No. 4,779,720 (Mandelbaum) discloses a combination shipping and display device for neckties and the like. The device basically comprises a generally rectangular, open faced inner carton. That carton includes an assembly of hanger rods supported from an assembly of horizontal and vertical rods. The assembly of hanger rods and the associated horizontal and vertical rods are located and secured within the inner carton. The top of the inner carton folds backward and includes a flap affording an advertising panel and a tongue retained between the carton back panel and a top horizontal rod member in the display mode. A retainer assembly is also provided and includes spaced U-shaped apertures and baffles for laterally supporting columns of ties on the hangers. The inner carton and retainer assembly are inserted into a conventional outer carton for shipping. The assembly of hanger rods and the inner carton in which they are mounted, are arranged to be connected via a hook to a mesh panel, peg board or other vertical structure to support the inner carton holding the ties on that vertical structure.

U.S. Pat. No. 4,842,131 (Mandelbaum) discloses a combination shipping and display device for neckties and the like that is similar to the device of U.S. Pat. No. 4,779,720 (Mandelbaum), but which includes a hanger support structure. In particular, the hanger support structure is similar to the assembly of the hanger rods and associated horizontal and vertical rods, but is in the form of an outward facing U including a pair of end strips with holes for receipt of "Christmas tree" fasteners to secure the hanger support structure in the inner carton. The hangar support structure and the inner carton in which it is mounted, are arranged to be connected via a hook to a mesh panel, peg board or other vertical structure to support the inner carton holding the ties on that vertical structure.

U.S. Pat. No. 5,249,668 (Fenton et al.) discloses a revolvable rack for neckties that can be either temporarily or permanently hooked or fastened to a rod or a store fixture, and a container for shipping the rack while it is fully loaded with ties. The rack is easily rotated by hand, has a relatively small turning radius and has the capacity to hold several dozen ties. Once the tie rack is placed in the container, the container serves to both store and protect the ties in an organized and out-of-the-way manner. The tie rack and container combination can be hung together in an existing space. The container allows the fully loaded tie rack to be quickly and easily lifted out of the container in one smooth motion, and directly hung on a rod or on a merchandising fixture in a store without the use of special tools or equipment, such that the ties are readily and pleasingly displayed.

Other cartons including or adapted to make use hangers for garments or other merchandise are disclosed in the following U.S. Pat. No. 2,796,977 (Divine), U.S. Pat. No. 3,659,704 (Collura et al.), U.S. Pat. No. 3,987,898 (Crane), U.S. Pat. No. 4,098,399 (Behtune et al.), U.S. Pat. No. 4,576,280 (Dove et al.), U.S. Pat. No. 4,693,369 (Lagin) and U.S. Pat. No. 6,155,415 (Runyan).

While the devices of the aforementioned prior patents appear generally suitable for their intended purposes, they still leave something to be desired from one or more standpoints, such as simplicity of construction, ease of opening the container, ease of use, ease of disassembly of the container, ease of assembly of the container's fixture components, ease of carrying the container to effect the mounting of the fixture onto a vertical support surface and the ability of the fixture to be mounted on various types of vertical support surfaces to project out from those surfaces in either of two opposite directions.

In our copending U.S. patent application Ser. No. 10/305,501, filed on Nov. 27, 2002, entitled Ambidextrous Merchandise Fixture And Method of Displaying Merchandise Therefrom, which is assigned to the same assignee as this invention and whose disclosure is incorporated by reference herein, there is disclosed a fixture and method of use for supporting merchandise, e.g., plural garment belts, on a vertical support structure. That fixture is arranged to be mounted any one of various types of conventional vertical oriented support structures, such as a conventional slotted upright, a wire rack, a slat wall and a peg board, with the fixture projecting out from any of those structures in either of two opposite directions. To that end the fixture includes a bracket and an elongated display member having a pair of ends. The bracket includes a section for snap connection to either end of the display member and a connector that is configured to engage the vertically oriented support structure. The display member includes merchandise holders, e.g., plural prong hangers, for holding the merchandise thereon, e.g., suspending the merchandise therefrom.

The subject invention makes use of the fixture of our aforementioned patent application in an integrated system, i.e., a system including a shipping carton and the merchandise, that is simple in construction, low in cost and easy to use.

BRIEF SUMMARY OF THE INVENTION

In accordance with one aspect of this invention there is provided an assembly for transporting, storing and merchandising plural suspended articles of merchandise, e.g., garment belts. The assembly comprises a shipping container in which a fixture and the plural articles of merchandise are located. The fixture basically comprises an elongated display member and a bracket.

The elongated display member, e.g., a linear tube of square cross section, has a pair of ends and plural hanger members. The plural hanger members, e.g., plural prongs, serve to suspend the articles of merchandise from them. The bracket comprises a first section and a second section. The second section extends at an angle to the first section and is arranged to be releasably connected to, e.g., to snap fit into, either one of the ends of the elongated display member. The first section of the bracket includes a connector arranged to engage a portion of a vertically oriented structural member, e.g., a conventional slotted upright or standard for shelving, a wire rack, a slat wall, a peg board, etc., to mount the fixture and the container on the vertically oriented structural member so that the elongated display member extends outward from the vertically oriented structural member. The container is removable from the assembly while the fixture is mounted on the vertically oriented structural member, whereupon the plural articles of merchandise hang downward from the fixture for display. Optionally, the elongated display member may include a panel arranged to be secured thereto for carrying advertising or promotional indicia thereon.

In accordance with another aspect of this invention there is provided a container for holding a fixture having plural articles of merchandise, e.g., garment belts, preloaded on the fixture. The container comprises an outer carton having an inner compartment. The container is formed of a blank of a planar material capable of being folded along plural fold lines to form the outer carton and the inner compartment. The outer carton is a hollow member in which at least portions of the plural articles of merchandise are located. The inner compartment is arranged to support at least a portion of the fixture therein. The outer carton comprises at least one weakened portion arranged to removed from the outer carton to provide access to the inner compartment and to the fixture.

The container is arranged to be carried to a location having a vertically oriented structural member, e.g., a slotted upright, a wire rack, a slat wall, a peg board, etc., to mount the fixture thereon, while the fixture remains supported by the inner compartment. At least a portion of the outer carton is arranged to be removed from the inner compartment to expose the plural articles of merchandise while the fixture is mounted on the vertically oriented structural member. The inner compartment and any remaining portion of the outer carton are arranged to be removed from the fixture while the fixture is mounted on the vertically oriented structural member, leaving the fixture mounted on the vertically oriented structural member, with the plural articles of merchandise supported by the fixture.

In accordance with another aspect of this invention there is provided a method of packaging and storing plural items of merchandise, e.g., garment belts, for subsequent display. The method comprises providing a shipping container for holding a fixture. The container comprises an outer carton having an inner compartment, with the outer carton being a hollow member and having a severable, e.g., perforated, portion. The plural articles of merchandise are preloaded on, e.g., suspended from, the fixture. The fixture with the preloaded merchandise thereon is located within the container so that at least a portion of the fixture is supported by the inner compartment and with at least portions of the plural articles of merchandise being located within the outer carton, to protect the fixture and the articles of merchandise and to enable them to be shipped to a remote location where the severable portion of the outer carton can be removed to expose the fixture to enable it to mounted on a vertically oriented structural member, e.g., a slotted upright, a wire rack, a slat wall, a peg board, etc. Then the remainder of the shipping container can be removed, leaving the fixture mounted on the vertically oriented structural member, with the plural articles of merchandise supported by the fixture.

The fixture may include an elongated display member having at least one end and may be arranged to be mounted on the vertically oriented structural member by the at least one end. In such a case the method additionally comprises removing the severable portion of the outer carton to expose the at least one end of the elongated display member. The shipping container can then be carried to the location of the vertically oriented structural member to mount the elongated display member on it while the elongated display member is supported by the inner compartment of the shipping container. The inner compartment and any portion of the outer carton are then removed to leave the fixture mounted on the vertically oriented structural member, with the plural articles of merchandise supported by the fixture.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
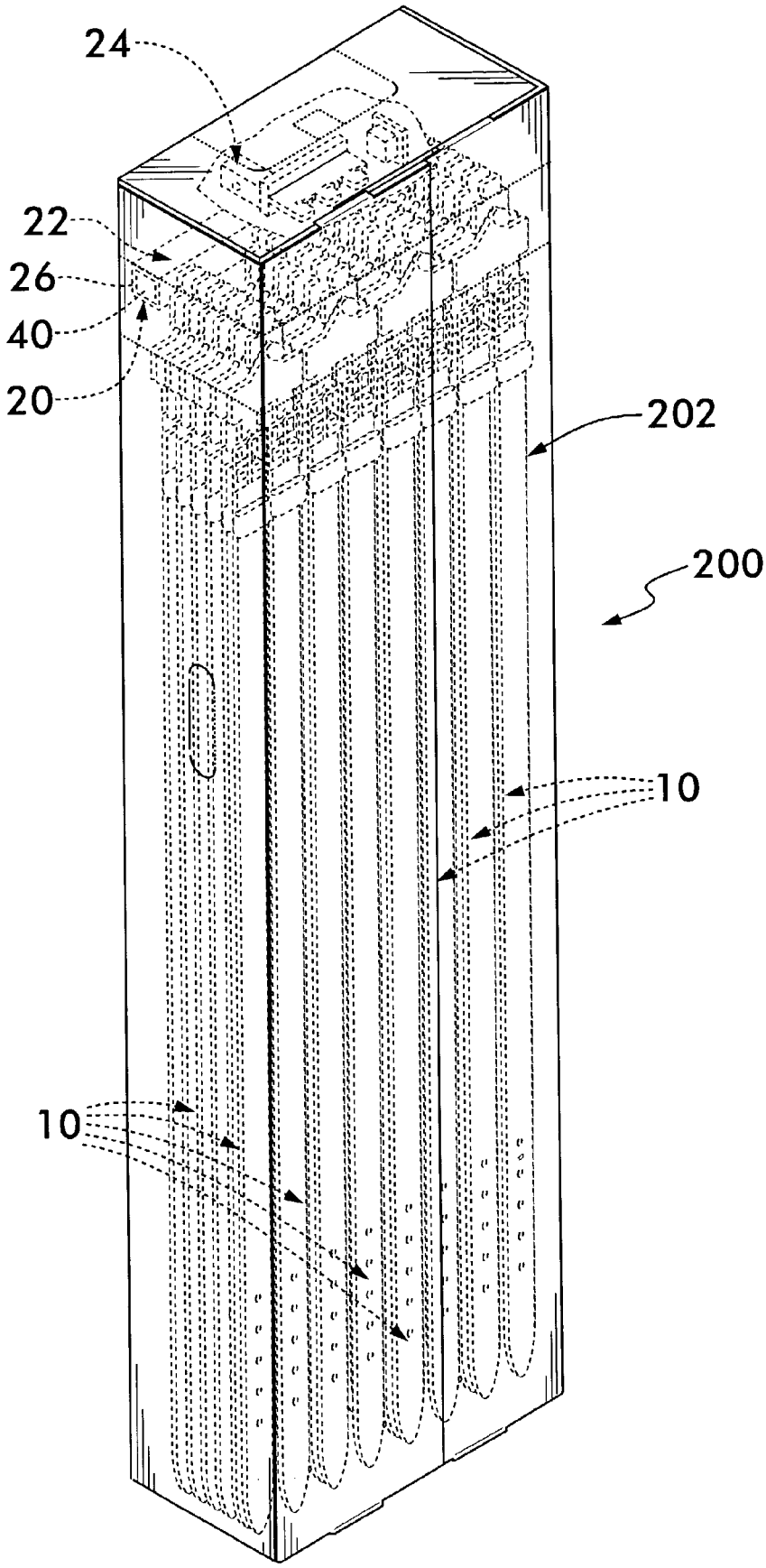
FIG. 1 is an isometric view of one exemplary embodiment of a fully assembled shipping container holding plural items of merchandise (shown by phantom lines) and a fixture (also shown by phantom lines) for displaying those items.

Referring now in greater detail to the various figures of the drawing, wherein like reference characters refer to like parts, an assembly embodying the present invention is generally shown at 200 in FIG. 1. The assembly 200 basically comprises a shipping container 202 holding plural items of merchandise 10 and a fixture 20 for displaying those items. The fixture 20 is constructed in accordance with the teaching of our aforementioned copending patent application and includes an elongated display member 22 (FIGS. 1 and 8) having a pair of open ends and a bracket 24 (whose details will be described later) for releasable securement to the elongated display member 22 at either of those ends. When the bracket 24 is connected to the elongated display member 22 the resulting fixture 20 is ready to be releasably mounted on a vertical oriented structural member, e.g., a conventional slotted upright or standard for shelving, a wire rack, a slat wall, a peg board, etc.

The container 202 of this invention is arranged to temporarily mount the display member 22 of the fixture 20 therein, with the items of merchandise, e.g., garment belts 10, pre-loaded on, e.g., hung from, the display member 22, and to also house the bracket 24. With the fixture components and the items of merchandise 10 within the container, the container can be closed or sealed to the state shown in FIG. 1, whereupon it can be shipped or otherwise transported from the manufacturer or supplier of the merchandise to the retail or other business establishment at which the items are to be displayed and/or sold. As will be described in detail in the description to follow, the container 200 is also arranged to be readily opened to enable the bracket 24 to be removed from it and connected to either end of the elongated display member 22 to partially assemble that fixture. Then the container can be lifted to carry it, with the partially assembled fixture, to the vertically oriented structural member to mount the carton and the partially assembled preloaded fixture onto that structure. Once that has been accomplished the remainder of the carton can be removed, leaving the preloaded fixture in place on that structure. The remaining components of the fixture, e.g., a header and an end cap (both to be described later) can then be mounted on the fixture to complete the display.

Figure 6:
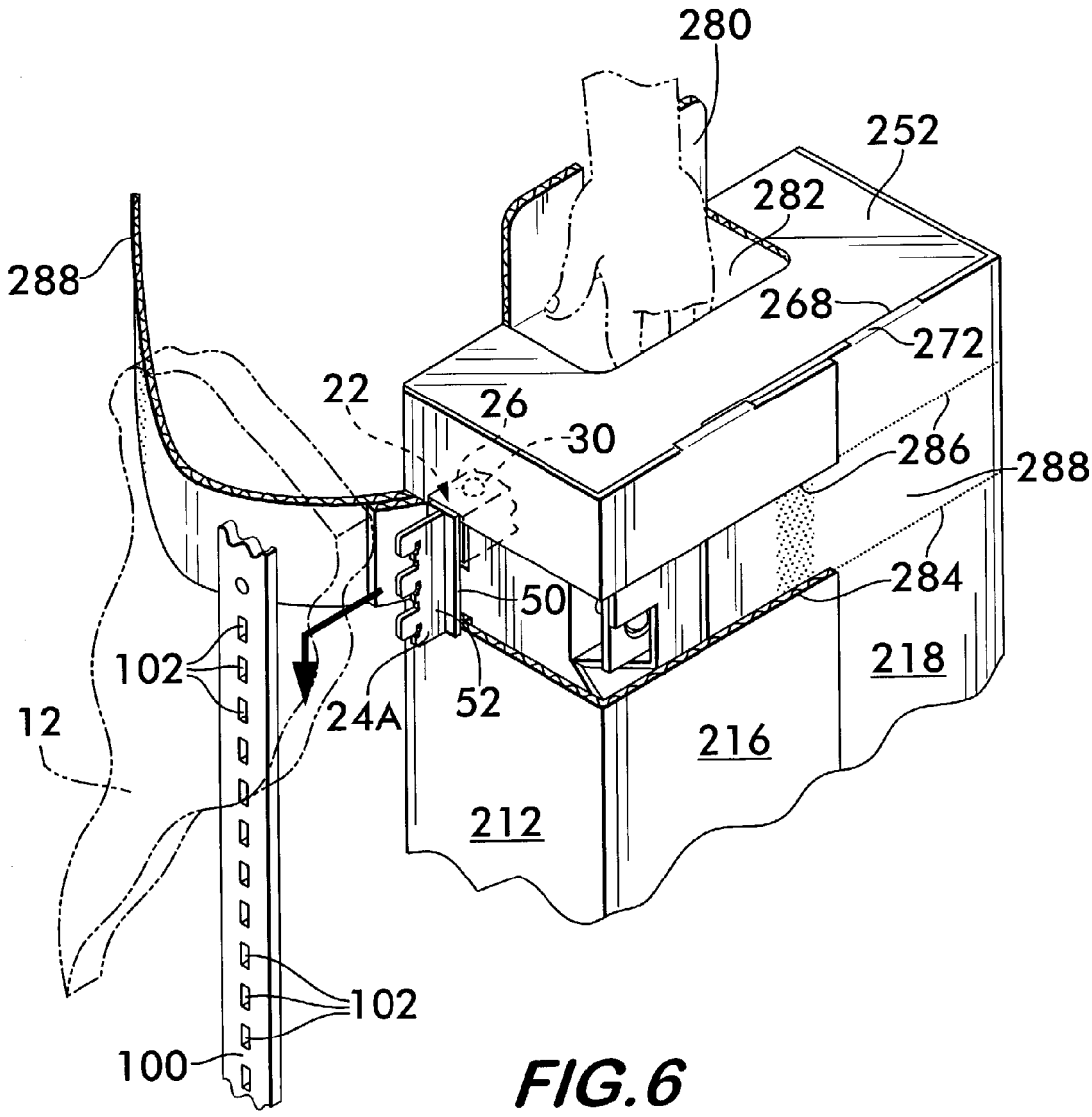
FIG. 6 is an isometric view, like that of FIGS. 4 and 5, but showing the next successive step in the use of the container, this step being the process of mounting the fixture and the shipping container on one exemplary vertically oriented structural member, e.g., a conventional slotted upright.
Figure 8:
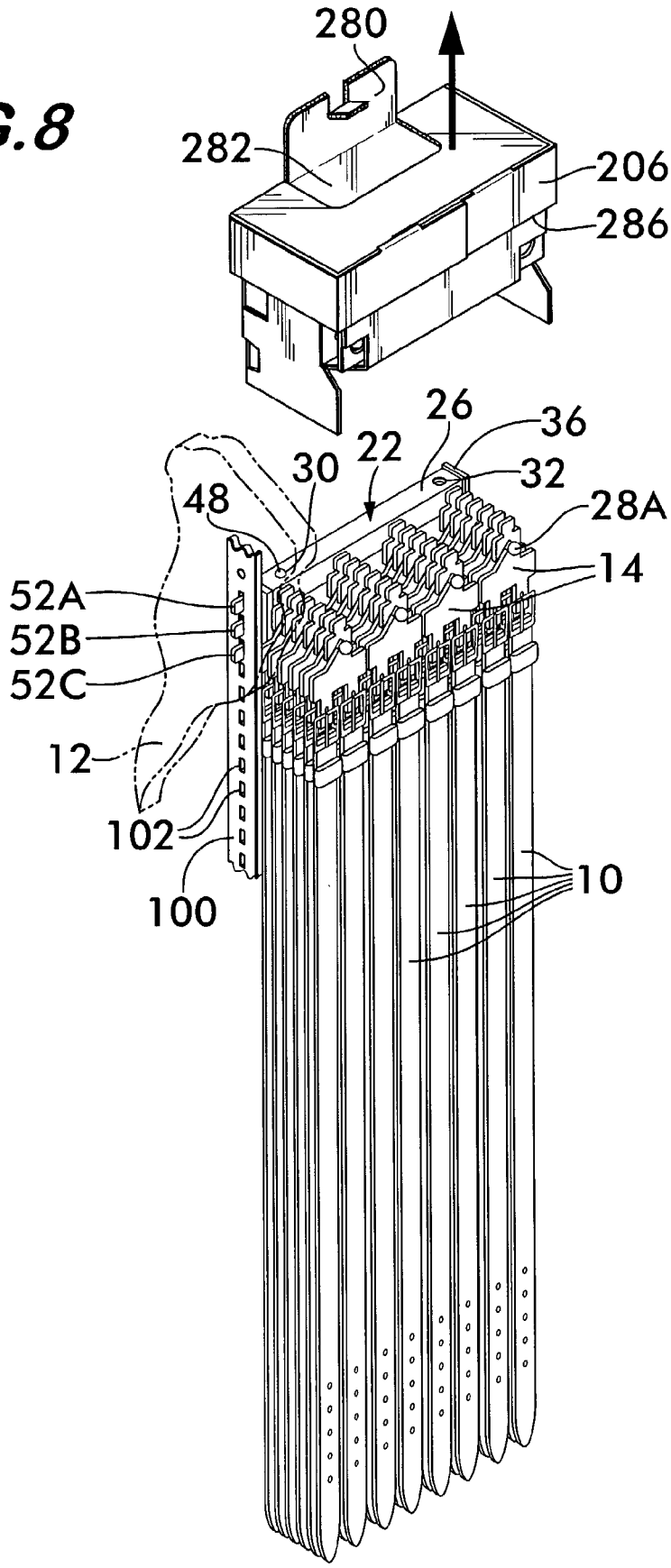
FIG. 8 is an isometric view, like that of FIGS. 4–7, but showing the final step in the use of the container, this step being the process of removing the top or remaining portion of the shipping container from the mounted fixture.

It should be pointed out at this juncture that the fixture 20 shown herein is arranged to be releasably mounted on a conventional slotted upright 100 (FIGS. 6 and 8). That is merely exemplary. Thus, a fixture 20 constructed in accordance with this invention and our heretofore identified copending patent application, can be constructed so that its bracket 24 includes a connector (to be described later) that is particularly suitable for the particular type of vertically oriented structural member it is releasably secured to, e.g., any one of the types of vertically oriented structural members disclosed in our aforementioned copending patent application, e.g., a wire rack, slat wall, peg board, etc. Moreover, while the items of merchandise 10 in the exemplary embodiment shown and described herein comprise conventional garment belts, it is clear that they can be other items suitable for suspension from the fixture (as also disclosed in my aforementioned copending patent application). In fact the items of merchandise need not be even suspendable so long as they can be supported by the fixture.

Figure 7:
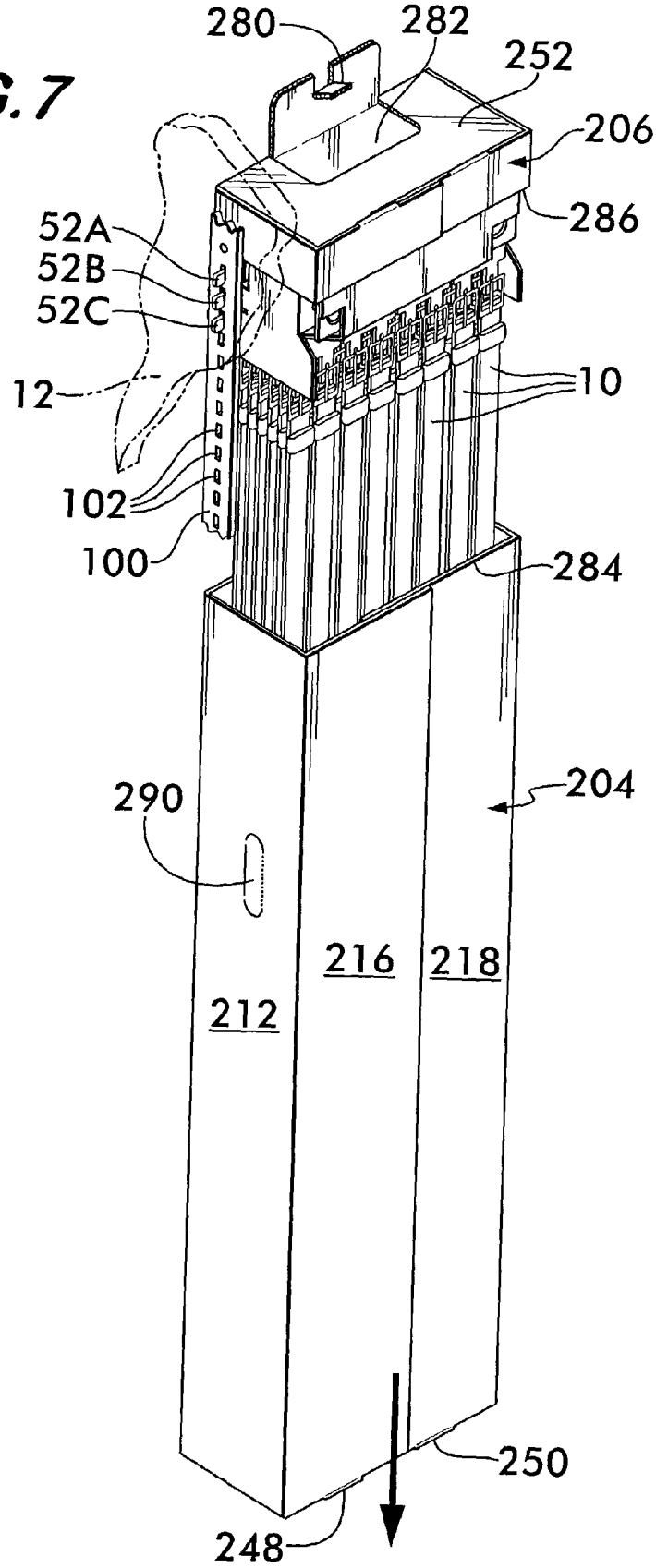
FIG. 7 is an isometric view, like that of FIGS. 4–6, but showing the next successive step in the use of the container, this step being the process of removing the bottom portion of the outer carton of the shipping container while the top portion of the container and the fixture is mounted on the exemplary vertically oriented structural member (the conventional slotted upright) to expose the merchandise suspended from the fixture.

In the interest of facilitating the understanding of this invention, the details of the construction and operation of the fixture 20 will be discussed before discussing the features of the container 200. To that end as best seen in FIGS. 3E, 5, 6 and 8, the fixture 20 comprises the heretofore identified elongated display member 22 and the bracket 24. The bracket 24 includes an adaptor or connector (to be described later) that is particularly constructed and arranged to cooperate with any one of various types of conventional vertically oriented support means mounted on a wall 12 (FIGS. 6–7) of the establishment where the fixture is to be used to display/sell the merchandise 10. In the exemplary embodiment shown the bracket's adaptor or connector is arranged to be releasably mounted on a conventional slotted upright or standard 100, such as those typically used for shelving.

Figure 3A:
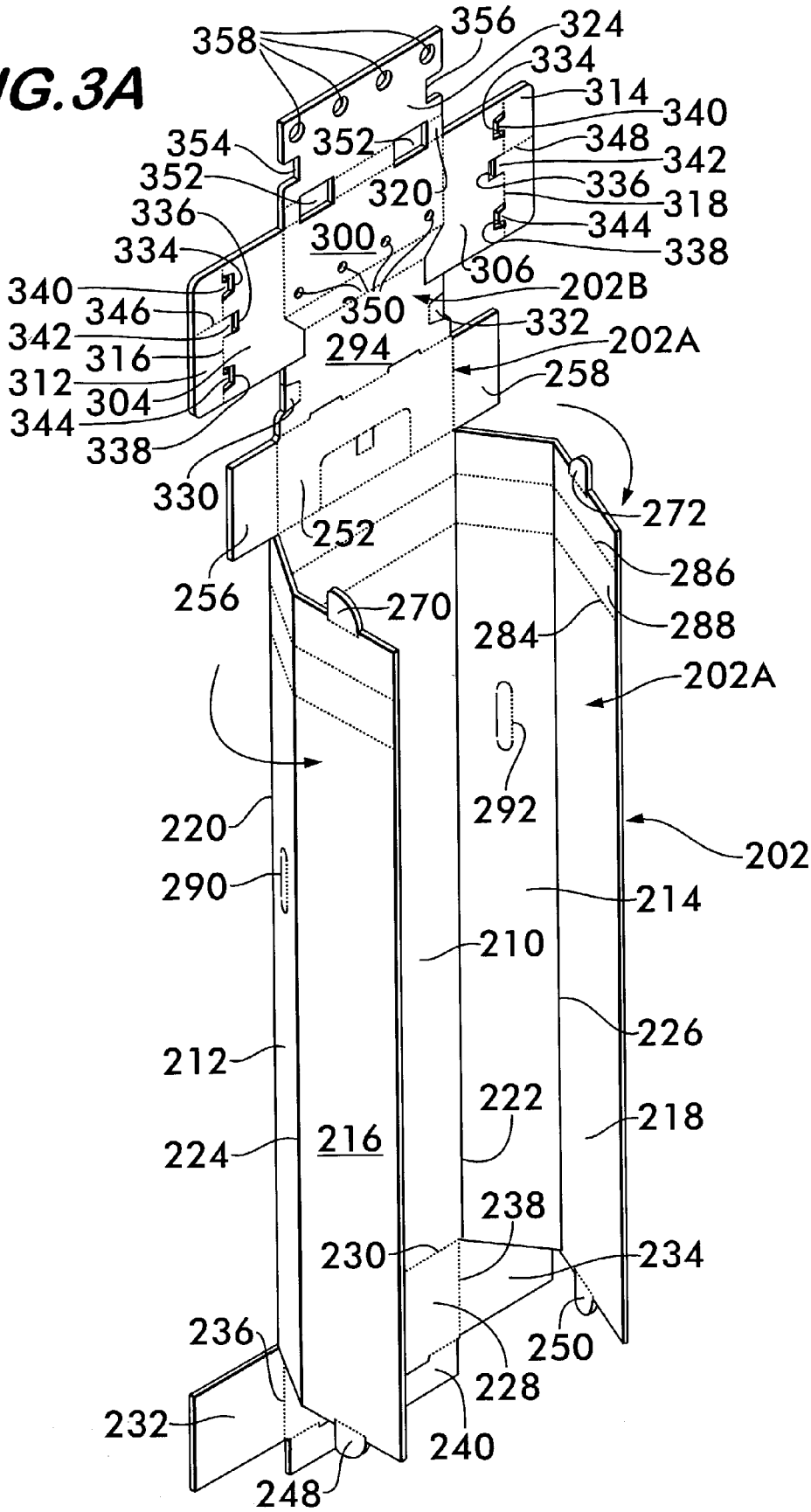
FIG. 3A is an isometric view of the shipping container shown in FIG. 2 at an initial folding step in its assembly.
Figure 5:
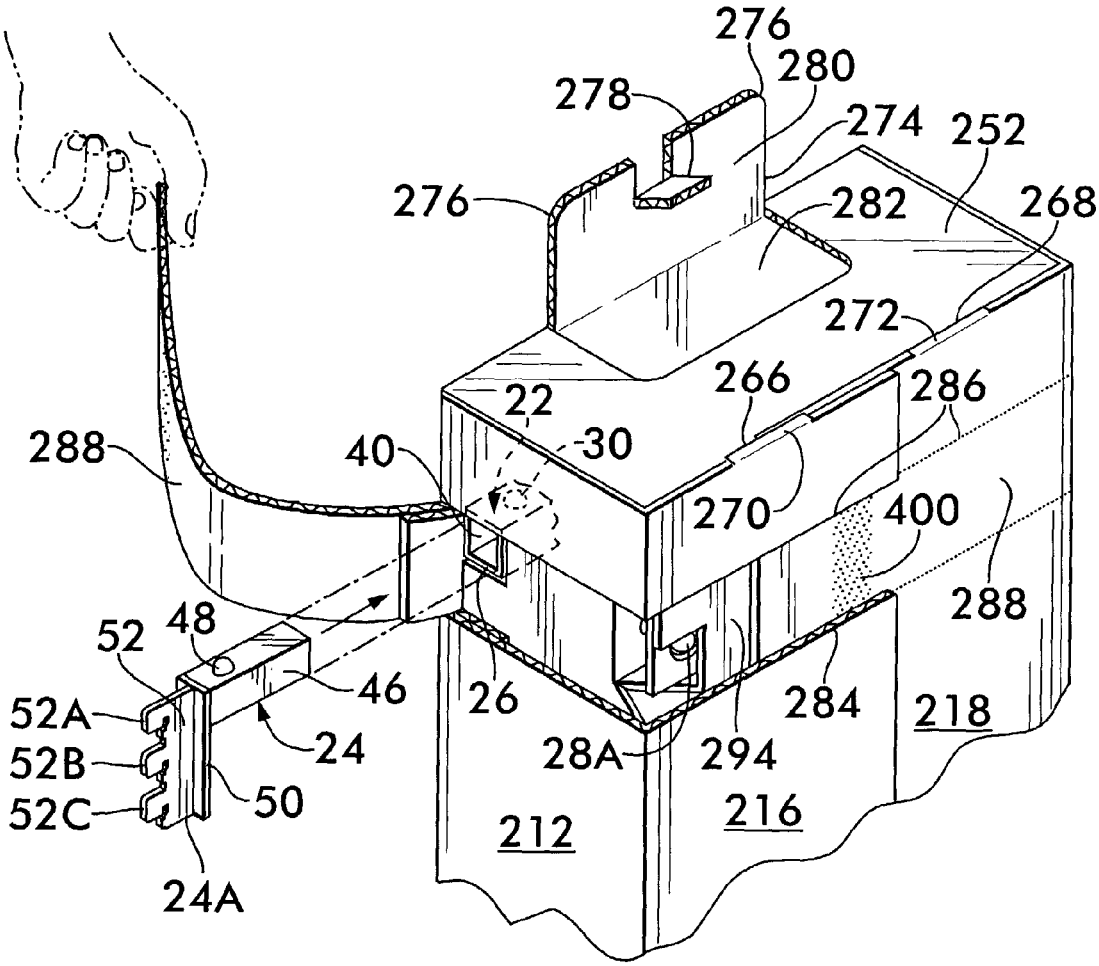
FIG. 5 is an isometric view, like that of FIG. 4, but showing the next successive step in the use of the container, this step being the process of opening the outer carton of the shipping container to provide access to another one of the fixture components to enable the assembly of the fixture.

Before describing the details of the adaptor/connector of the bracket 24, a description of the other components of the fixture 20 is in order. To that end, as best seen in FIGS. 3A, 5 and 8, the elongated display member 22 basically comprises a tubular member 26 having a plurality of merchandise holders or prongs 28 projecting therefrom. The tubular member 26 includes a pair of connector-receiving holes or apertures 30 (FIGS. 5 and 6) and 32 (FIG. 8) in its top wall located adjacent its respective ends. The fixture 20 also includes an optional header (not shown) for bearing indicia for advertising, sizing, pricing or other purposes, and an end cap 36. If a header is used the fixture 20 includes and assembly, e.g., fasteners and associated holes (not shown), for mounting the header on the top wall of the tubular member 26. Being a tube, the member 22 includes a pair of ends 40, only one of which can be seen (FIG. 5), each of which is hollow. In the exemplary embodiment the tubular member 26 is linear and has a square cross-sectional shape. Each of the open ends of the member 26 is arranged to releasably receive a portion of the adaptor/connector of the particular bracket 24 chosen for use with the particular wall mounted support means, e.g., slotted upright 100. This arrangement enables the bracket 24 to mount the elongated display member 22 on the slotted upright 100 from either end of the elongated display member 22.

Figure 3B:
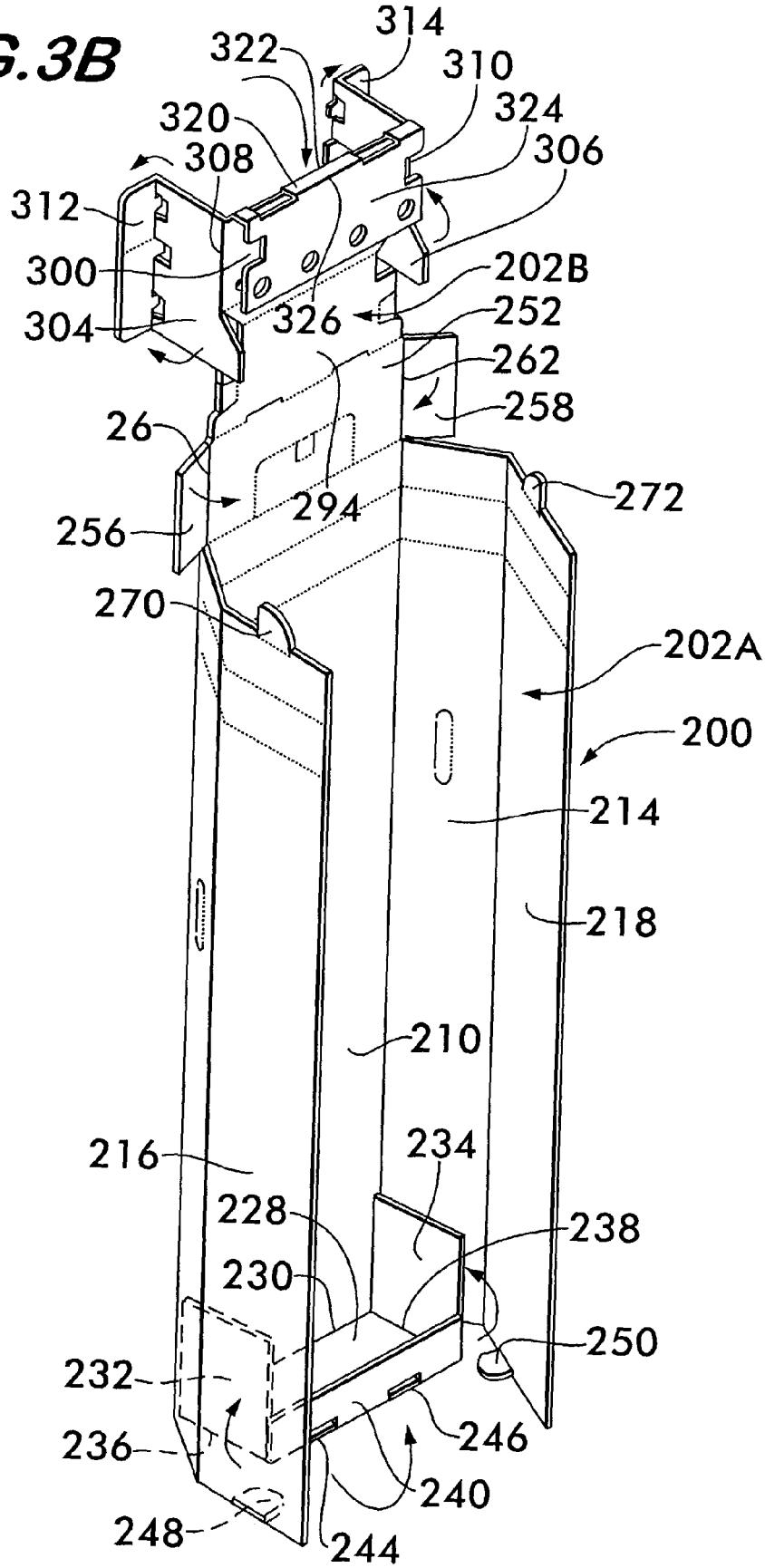
FIG. 3B is an isometric view, like that of FIG. 3A, but showing the next folding step in the assembly of the shipping container.
Figure 3C:
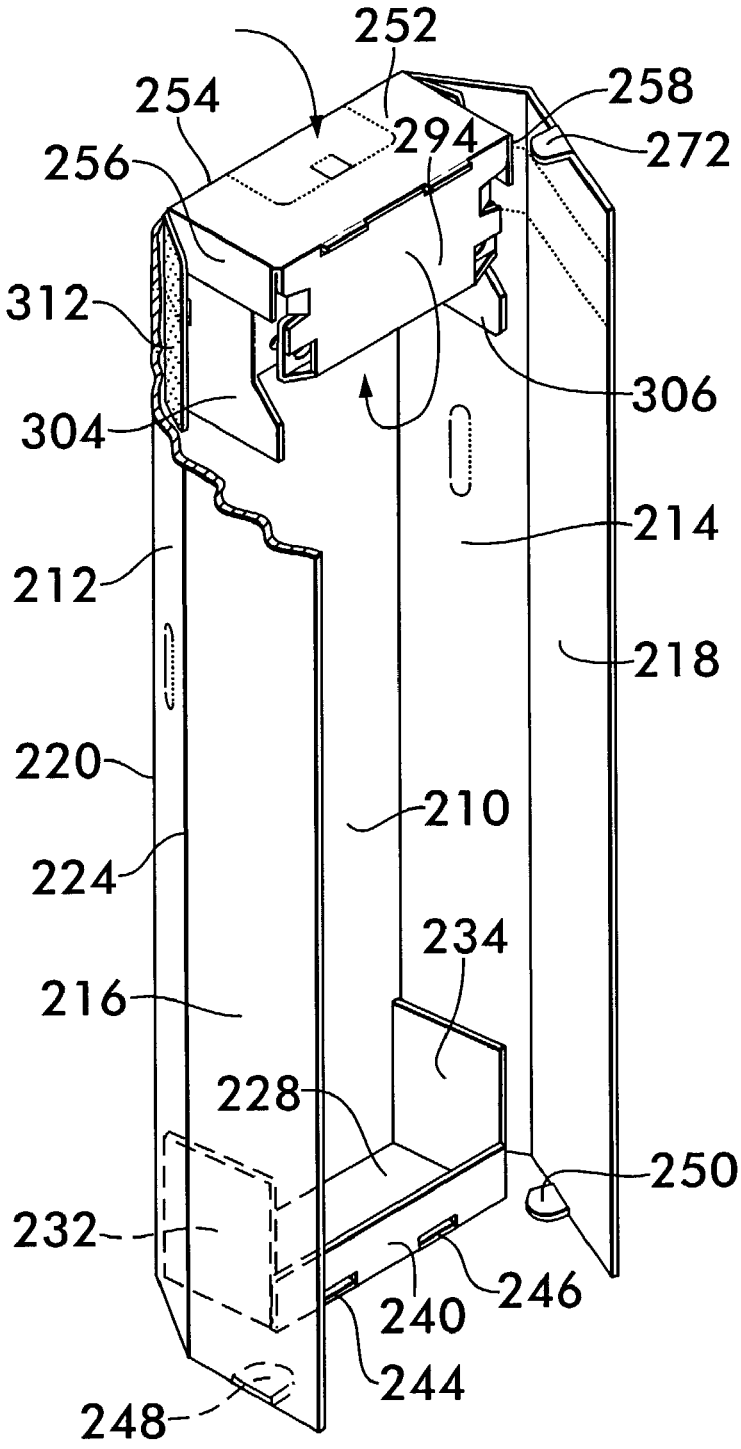
FIG. 3C is an isometric view, like that of FIGS. 3A and 3B, but showing the next folding step in the assembly of the shipping container.
Figure 3D:
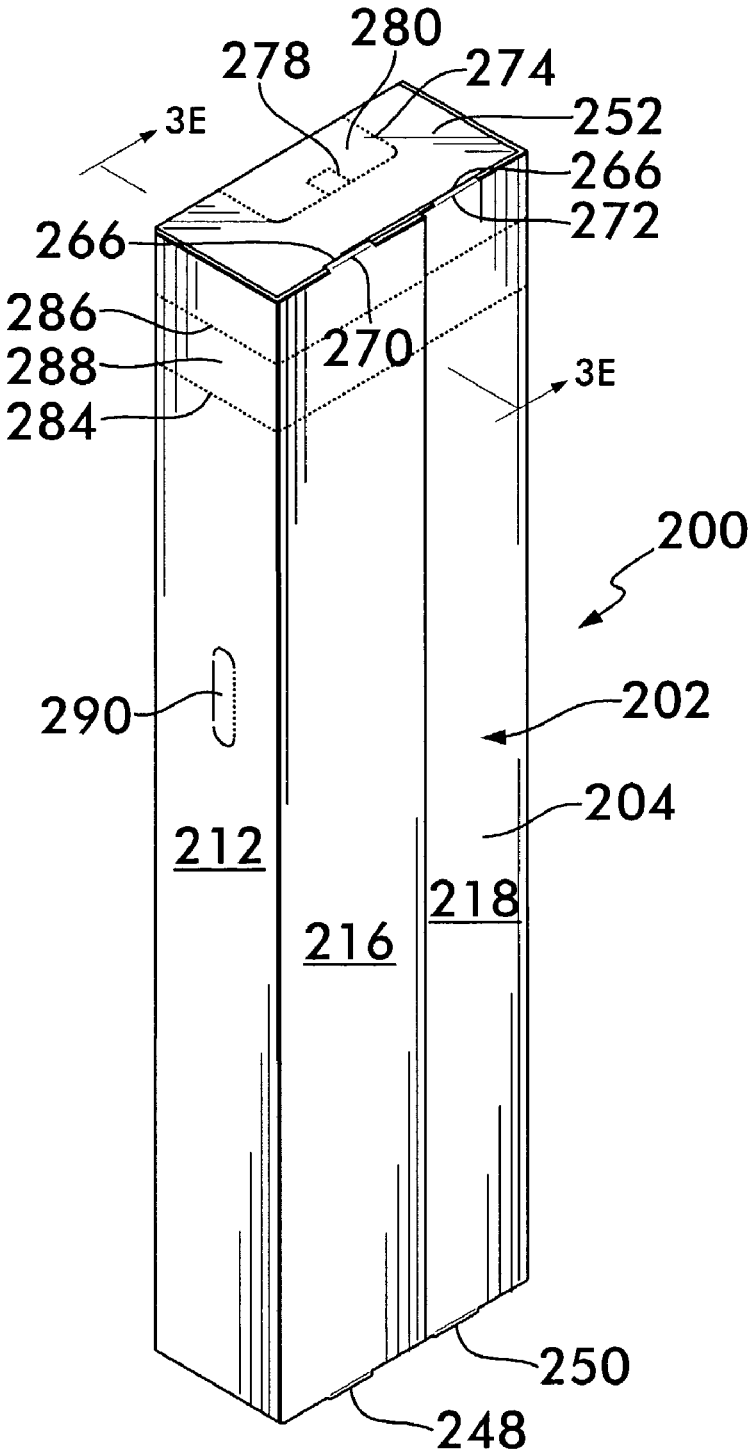
FIG. 3D is an isometric view, like that of FIGS. 3A–3C, but showing the shipping container fully assembled.
Figure 3E:
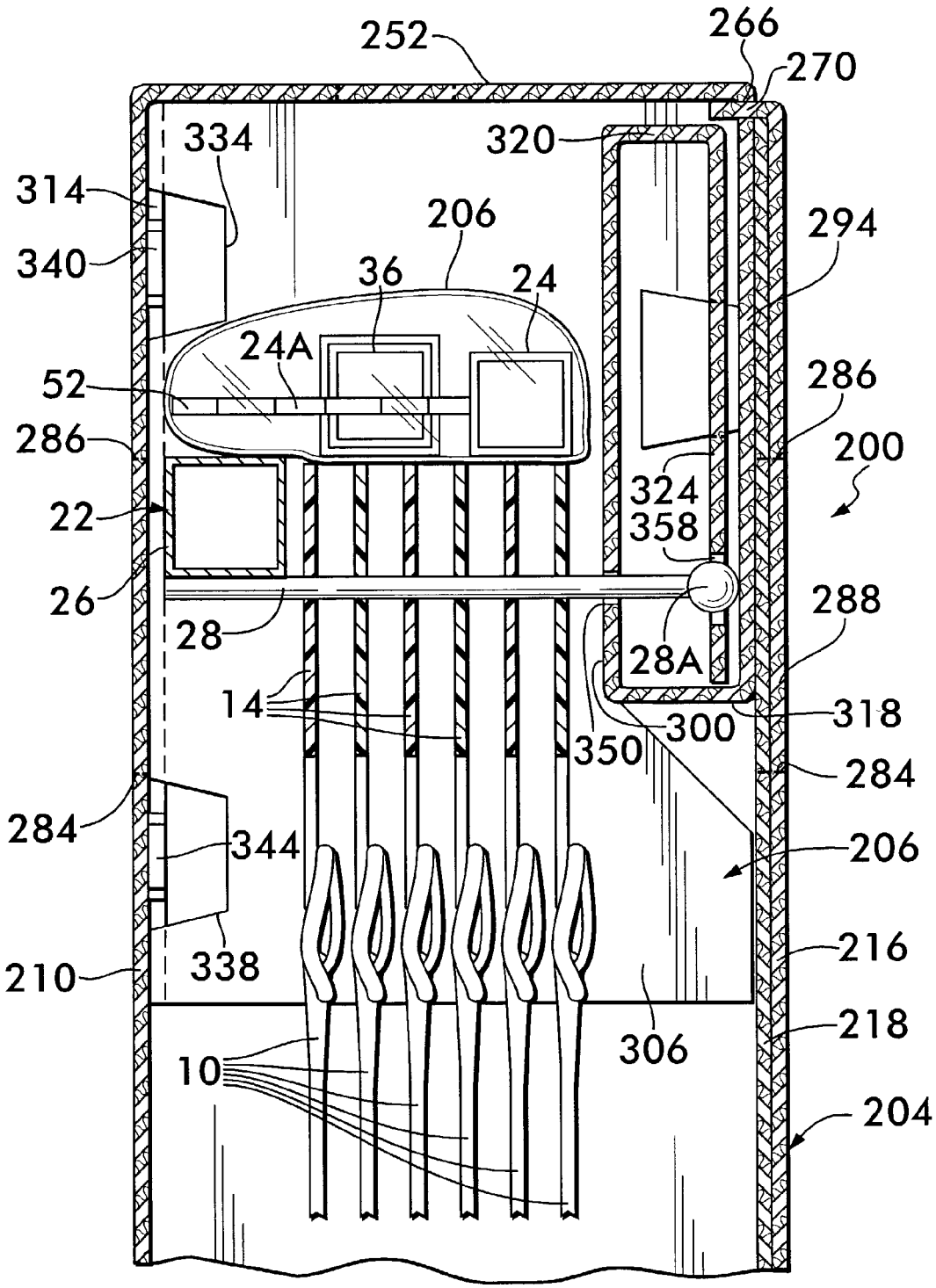
FIG. 3E is an enlarged sectional view taken along line 3E—3E of FIG. 3D.

As best seen in FIG. 3E each of the prongs 28 comprises a rod having one end fixedly secured, e.g., welded, to the underside of the bottom wall of the tubular member 26 and a free end in the form of a bulbous or spherical head 28A. The prongs 28 are equidistantly spaced along the length of the tubular member 26. In the embodiment shown each of the prongs is of the same length, but such an arrangement is merely exemplary. Thus, the prongs can be of different lengths. In the exemplary embodiment shown, each prong 28 serves to suspend plural garment belts 10 from it. In particular, a pair of belts 10 are mounted by their buckles to a conventional plastic hanger tag 14 (FIGS. 3E and 8). The hanger tag 14 includes a hook portion which is arranged to snap fit over any of the prongs 28 to suspend the hanger tag and its pair of belts from that prong. Plural hanger tags may be suspended from a single prong, as shown clearly in FIGS. 3E and 8. As is conventional, the hanger tag 14 may include advertising or promotional material, sizing information, etc.

Referring now to FIG. 5, the details of the bracket 24 utilizing a connector 24A particularly configured for releasably mounting the fixture 20 onto a conventional slotted upright 100, will now be described. That bracket basically comprises a first section which makes up the connector 24A and a second section 46. The first section is preferably formed of the same material, e.g., steel, as the tubular member 26, and is a somewhat elongated member that is arranged to be closely received within either open end 40 or 42 of the tubular member 26 making up the elongated display member 22. Thus, in the exemplary embodiment shown the section 46 is a hollow tube of square cross section, and whose cross sectional area is just slightly smaller than that of the hollow interior of either open end, e.g., 40, of the tubular member 26. This arrangement enables the section 46 to be inserted into either end of the elongated display member. In order to hold the section 46 within the elongated display member, the section 46 includes detent in the form of a spring-biased ball or domed pin 48 mounted in the top wall of the section 46 closely adjacent the connector 24A. The ball/pin 48 is arranged to snap-fit into the aperture 30 when the bracket 24 is secured to the left side of the elongated display member as viewed in FIGS. 5 and 6. Similarly, the ball/pin 48 is arranged to snap-fit into the aperture 32 when the bracket 24 is secured to the right side of the elongated display member (FIG. 8).

The connector 24A of the bracket 24 basically comprises an elongated planar plate or strip 50, preferably formed of metal, e.g., steel, that is fixedly secured, e.g., welded, to the end of the tubular section 46 adjacent the spring biased ball/pin 48. A conventional planar-like connector element 52 projects perpendicularly from the outer surface of the plate 50. The connector element 52 is arranged to fit within any of the slots 102 of the slotted upright 100. The connector element 52 is preferably formed of metal, e.g., steel, and includes three undercut ears 52A, 52B and 52C (FIG. 5), each of which is arranged to fit within a respective slot 102 (FIG. 6) in the slotted upright 100 to releasably mount the bracket 24 onto the upright 100. To that end, in order to mount the bracket 24 onto the slotted upright 100 the ears 52A, 52B and 52C of the bracket's connector 24A are inserted into three immediately adjacent slots at the desired height on the upright as shown in FIG. 6. The bracket 24 is then pushed inward so that the ears are entirely within the slots 102 in the upright 100 and then the bracket is pushed downward to bring the undercut portions of the ears into engagement with the portions of the upright contiguous with the bottoms of the slots 102, thereby locking the bracket in place (see the heavy line arrow in FIG. 6 depicting the directions that the bracket is pushed to connect it to the upright 100). With the bracket 24 mounted on the upright 100, the elongated display member 22 projects perpendicularly from the wall 12 on which the upright is mounted as shown clearly in FIG. 8. This arrangement enables customers to closely examine the belts 10 suspended from the fixture 20.

In order to provide a clean and finished appearance for the elongated display member 22, and to cover any potential sharp edges of its free end which might tend to injure a customer, the fixture 20 includes the previously identified cap 36. The cap is formed of any suitable material, e.g., steel, and is arranged to frictionally fit within whichever open end of the tubular member 26 that isn't secured to the bracket 24.

Figure 2:
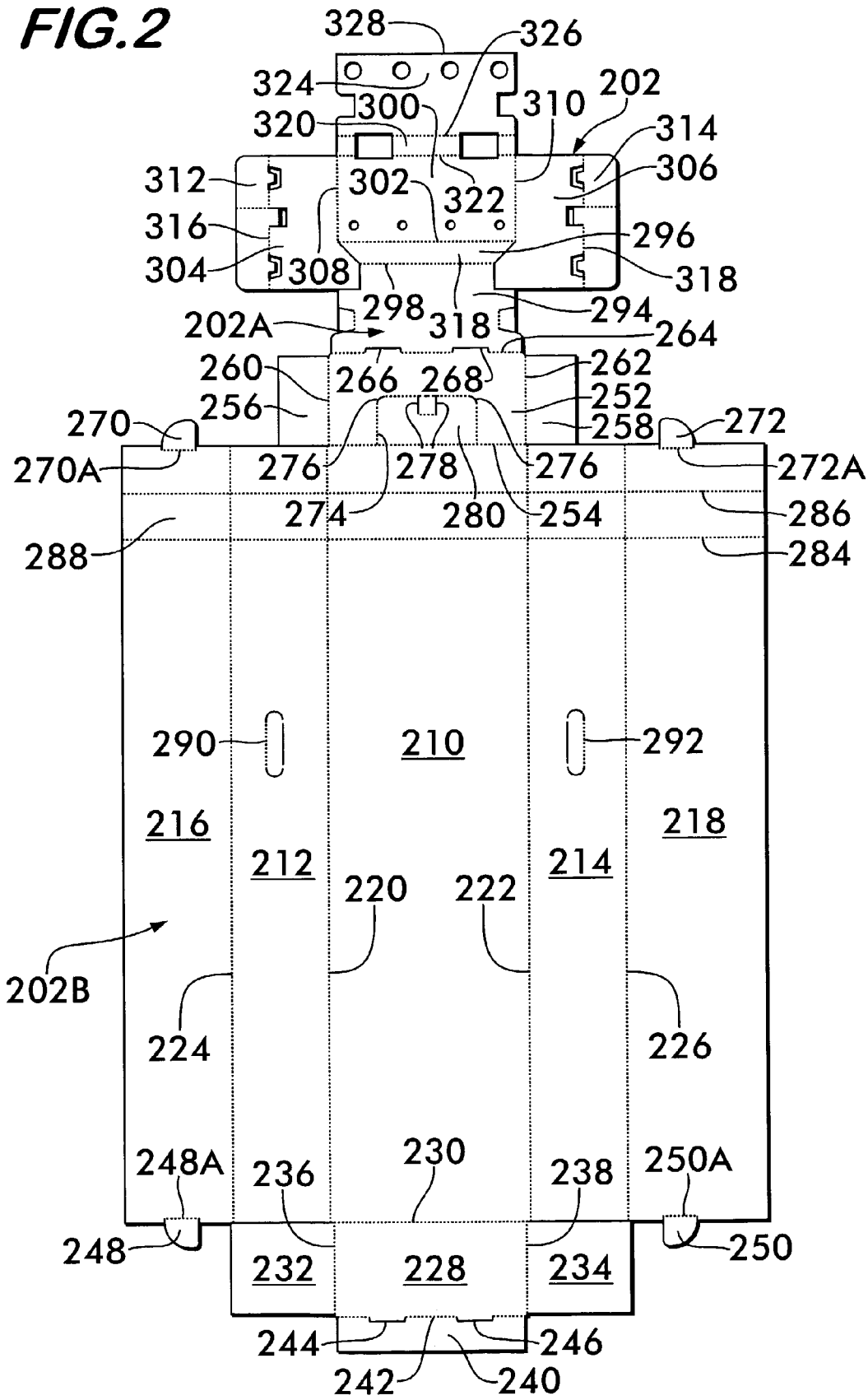
FIG. 2 is a plan view of the shipping container of FIG. 1 shown in a flat condition prior to being folded, assembled and filled with the fixture and the plural items of merchandise.

Referring now to FIG. 2 it can be seen that the container 200 is formed of a blank 202 of cardboard, paperboard or any other material, e.g., a plastic sheet, that is capable of being folded along various lines to form a hollow enclosure, like the parallelepiped shaped carton shown in FIG. 1. The blank 202 is divided into two basic sections 202A and 202B. The section 202A includes a plurality of rectangular shaped panels interconnected to each other by various fold lines, and which when folded along those lines form an exterior carton 204 (FIGS. 1 and 3D) of the container 200. The section 202B also includes another plurality of areas which are connected together by various fold lines, and which when folded along those lines form an interior compartment 206 (FIGS. 3C and 3E) of the container 200. The interior compartment 206 is arranged for holding the disassembled components 22 and 24 of the fixture 20 with the belts 10 suspended from a portion of that fixture. In particular, the interior compartment 206 holds a bag 208 in it and also supports the display member 22, with the belts 10 hanging from it. The bag 208 in turn serves to temporarily hold the bracket 24 and the end cap 36 of the fixture 20 so that they don't get misplaced and are readily available when the container 200 is partially opened to effect the assembly of the fixture within the container.

The section 202A of the blank 202 basically comprises a central back panel 210, a pair of side panels 212 and 214 and a pair of front panels 216 and 218. The central panel 210 is of rectangular shape, as are the side panels 212 and 214. The side panel 212 is connected to one side of the central back panel 210 by a linear fold line 220. The side panel 214 is connected to the other side of the central back panel 210 by a linear fold line 222. The front panel 216 is connected to the side panel 212 by a linear fold line 224. The front panel 218 is connected to the side panel 214 by a linear fold line 226. When the panels 212, 214, 216 and 218 are folded along their respective fold lines (as will be described later) they form the back, sides and front of the outer carton 204.

The bottom of the outer carton 204 is formed by another panel 228. To that end the section 202A of the blank 202 also includes a rectangular panel 228 connected to the bottom of the central back panel 210 by a linear fold line 230. The panel 228 forms the bottom of the carton. In order to enable the bottom panel 228 to be held in place when the carton is assembled, the section 202A also includes a pair of square flap panels 232 and 234 that are disposed on opposite sides of the bottom panel 228, via respective linear fold lines 236 and 238, and a rectangular end flap panel 240 connected to the bottom panel 228 by a linear fold line 242. A pair of slits 244 and 246 are provided in the fold line 242 for receipt of a pair of ears or tabs when the section 202A is assembled into the outer container 204. To that end, the lower edge of the front panel 216 includes an ear or tab 248 projecting outward at a fold line 248A, while the lower edge of the front panel 218 includes a similar ear or tab 250 projecting outward at a fold line 250A.

The top of the outer container is formed by another panel 252 of the section 202A. In particular, the section 202A includes a rectangular panel 252 connected to the top of the central back panel 210 via a linear fold line 254. In order to enable the top panel 252 to be held in place when the carton is assembled, the section 202A also includes a pair of rectangular flap panels 256 and 258 that are disposed on opposite sides of the top panel 252 via respective linear fold lines 260 and 262. The upper most edge of the top panel 252 is in the form of a linear fold line 264. This fold line forms the interface between the sections 202A and 202B of the blank 202. The fold line 264 includes a pair of slits 266 and 268 for receipt of a pair of tabs or ears when the section 202A is assembled into the outer container 204. To that end, the upper edge of the front panel 216 includes an ear or tab 270 projecting outward therefrom at a fold line 270A, while the upper edge of the front panel 218 includes a similar ear or tab 272 projecting outward at a fold line 272A.

Figure 4:
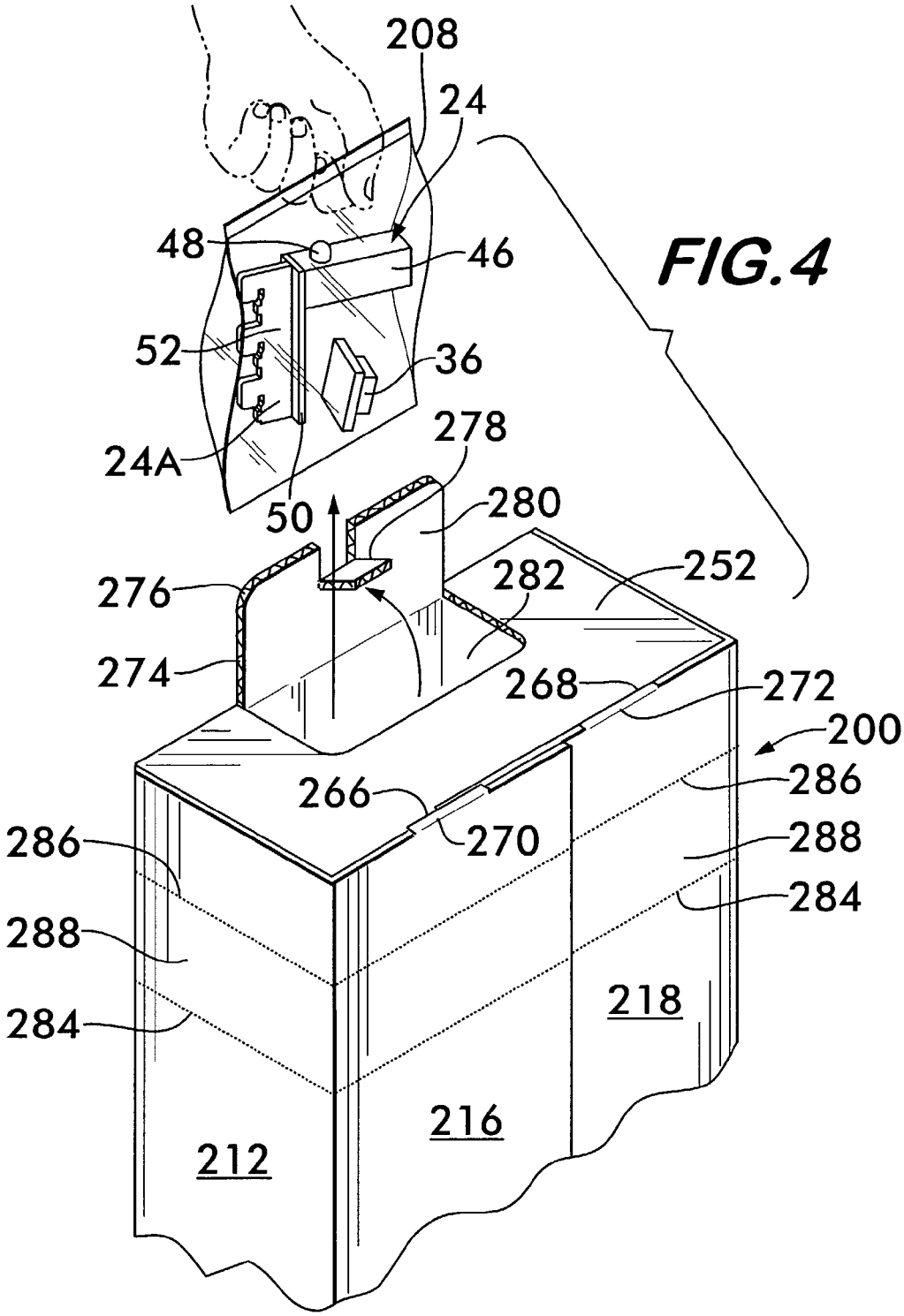
FIG. 4 is an isometric view of the top portion of the shipping container of FIG. 1 shown at an initial step in the use of the container, e.g., the container in the process of being opened to provide access to at least one of the fixture components.

The top panel 252 includes a weakened or perforated generally U-shaped line 274. The corners of the line 274 are in the form of rounded cuts 276. A pair of slits 278 extend inward from the center portion of the U-shaped line 274. The slits and the weakened or perforated line 274 enable the user of the device to break the perforations to form a flap 280 to provide access to the bag 206 as shown in FIG. 4, and as will be described later. This action also creates a handle opening 282 in the top panel 252 to facilitate the carrying of the container 200 (as will also be described later).

A pair of perforated or weakened lines 284 and 286 extend parallel to each other across the full width of the section 202A slightly below the fold line 254. The weakened lines 284 and 286 form a tear strip 288 between them. This tear strip is arranged to be grasped and torn away from the outer carton 204 by the user to provide access to the elongated display member 22 of the fixture 20, as will be described later.

In order to further facilitate the handling of the container 202, the side panels 212 and 214 include respective flat oval shaped perforated and slit lines 290 and 292 to form handles for the container.

As best seen in FIG. 2 the section 202B which forms the inner compartment 206 basically comprises a panel 294 of generally rectangular shape and which is connected to the top panel 252 by the fold line 264. The opposite side of the panel 294 is connected to a narrow generally trapezoidal shaped panel 296 by a linear fold line 298. The trapezoidal shaped panel 296 is connected to a rectangular shaped panel 300 by a linear fold line 302. A pair of side panels 304 and 306 are connected via respective linear fold lines 308 and 310 to opposite sides of the panel 300. Each of the side panels is of a generally rectangular shape with a wedge shaped portion projecting inward toward the panels 294 and 296. The outer marginal edges of the side panels 304 and 306 are in the form of two generally rectangular flaps 312 and 314 connected to the side panels by respective linear fold lines 316 and 318. A narrow rectangular panel 320 is connected to the panel 300 via a linear fold line 322. A generally rectangular notched panel 324 is connected to the panel 320 via a linear fold line 326. The free edge of the panel 326 is in the form of a linear edge.

As best seen in FIG. 3A the panel 294 includes a pair of foldable tabs 330, each of which is formed by a pair of merging slits joined at their inner ends by a fold line. Each of the side panels 304 and 306 include three notches 334, 336 and 338 in their portions contiguous with their respective fold lines 316 and 318. Three generally trapezoidal shaped tabs 340, 342 and 344 of the respective flaps 312 and 314 are located within the notches 334, 336 and 338, respectively, the side panels 304 and 306, respectively. The flap 312 includes a perforated line 346 extending to the middle notch 336 of the side panel 304. A similar perforated line 348 extends to the middle notch 336 of the side panel 306. The panel 300 includes a plurality of circular holes 350 that are equidistantly spaced and are arranged to receive the prongs 28 of the fixture 20, as will be described later. A pair of rectangular openings 352 are located within the narrow rectangular panel 320. The panel 324 includes a pair of rectangular notches 354 and 356 in the opposite side edges thereof. A plurality of circular holes 358 are located at equidistantly spaced locations along the free edge 328 of the panel 324. The opening 358 are arranged to receive the bulbous ends 28A of the fixture's prongs 28, as will also be described later.

The assembly of the container 200 will now be described. To that end as can be seen in FIG. 3A, the two side panels 212 and 214 are folded upward in the direction of the arrows with respect to the rear panel 210 along respective fold lines 220 and 222. The front panels 216 and 218 are folded inward with respect to the side panels 212 and 214, respectively, in the direction of those arrows along respective fold lines 224 and 226.

Then, as seen in FIG. 3B, the flaps 232 and 234 are folded inward with respect to the bottom panel 228 along their respective fold lines236 and 238 in the direction of the two outermost arrows. The bottom panel 228 is then folded upward along its fold line 230 in the direction of the central panel 210. The flap 240 is also folded upward along its fold line 242 with respect to the bottom panel 228 in the direction of that arrow. This action brings the flaps 232 and 234 into engagement with the inner surface at the bottom of the side panels 212 and 214, respectively. The tabs 248 and 250 are folded inward along their respective fold lines 248A and 250A to bring them to an orientation perpendicular to the plane of the front panels 216 and 218, respectively. As also seen in FIG. 3B, the panels 256 and 258 are folded upward or inward in the direction of the arrows along the fold lines 260 and 262, respectively, with respect to the top panel 252. The flaps 312 and 314 are folded upward or inward along their fold lines 316 and 318, respectively, with respect to the panels 304 and 306 to form a pair of mounting flanges for the interior compartment 206. The panels 304 and 306 are folded downward or backward along their fold lines 308 and 310, respectively, to form the sides of the interior compartment. The narrow panel 320 is folded upward or inward along its fold line 322. The notched panel 324 is folded downward or inward along its fold line 326 to form an intermediate wall of the interior compartment. Once the foregoing has been accomplished, the panel 300 is folded inward and downward with respect to the trapezoidal panel 318 along fold line 302. The trapezoidal panel 318 is in turn folded downward and inward with respect to panel 294 along the fold line 298. As best seen in FIG. 3D, this action brings the panel 324 into a parallel confronting relationship very close to the interior surface of the panel 294. The top panel 252 is then folded inward along its fold line 254 to the flaps 312 and 314 into a confronting relationship with the side panels 212 and 214.

The container is now ready to be loaded with the fixture components and the garment belts. To that end as can be seen in FIG. 3E, the elongated display member 22 of the fixture 20, with the garment belts 10 preloaded, i.e., hanging from its prongs 24, is mounted in the interior compartment 206 by extending the fixture's prongs 28 through the holes 350 in the panel 300 so that the bulbous ends 28A of each of those prongs is disposed within a respective opening 358 in the panel 324. The garment belts then extend downward into the portion of the container that defines the outer carton. The bag 206 with the fixture bracket 24 and the fixture end cap 36 is disposed within the interior compartment on top of the elongated tubular member 26 and the hanger members 14.

The container 20 is now ready to be sealed closed. To that end an adhesive is applied to the flaps 312 and 314 (alternatively the adhesive may be preapplied to the blank 202 in the areas forming those flaps). The two sidewalls 212 and 214 are then folded completely upward with respect to the rear panel 210 so that they are perpendicular thereto. This adhesively secures the flaps 312 and 314 to the side panels 212 and 214, respectively. In addition it brings the interior surface of the side panels 212 and 214 into engagement with the flaps 232 and 234, respectively, of the bottom panel 228. Next the front panel 218, which is wider in width than the front panel 216, is folded inward along its fold line so that it is parallel to the rear panel 210. This action brings the inner surface of the top portion of the front panel 218 into abutment with a portion of the panel 294 as shown clearly in FIG. 3E. The other front panel 216 is then folded inward along its fold line to bring its inner surface contiguous with its free edge into abutment with the underlying outer surface of the front panel 218. An adhesive 400 (FIG. 5) can be applied to the interface between these abutting portions of the front panels 216 and 218. Alternatively the seam between those two panels can be sealed with some adhesive tape. This completes the sealing of the container 200, whereupon the container looks like shown in FIG. 3D.

The container is ready to be shipped to the establishment, e.g., store, that will display the garment belts. The carrying of the container 200 can be effected by use of either or both of the handles 290 and 292 in the side walls. When the carton is ready to be opened to place the fixture on the particular vertically oriented support member, e.g., upright 100, in the retail establishment, all that is required is to press down on the portion of the top panel 252 between the slits 278 to form a finger-hole into which a finger can be extended to pull upward on the flap 280 to bend it out of the plane of the top panel as shown in FIG. 4. This action creates the heretofore identified opening 282. That opening provides access to the bag 206 containing the fixture's bracket 24 and its end cap 36. The bag can then be removed. The opening also forms a convenient handle for lifting the container 200.

In order to provide access to the elongated tube 26 forming the elongated display member 22, the user grasps the end of the tear strip 288 of the uppermost front panel 216 at the marginal edge of that panel and pulls the strip to cause the perforated lines 284 and 286 to tear. The user continues to pull on the strip until the desired hollow end of the tubular member 26 of the fixture is exposed. If the fixture is to be mounted via the leftmost end of the member 26, that end will be exposed first as shown in FIG. 5. If the other end of the member 26 is the end that is desired to mount the fixture on the vertically oriented support structure, the strip 288 is pulled completely about the periphery of the container to expose that end. Once the desired end of the tubular member is exposed, the bracket 24 is releasably secured thereto by inserting its section 26 into the hollow end until the spring loaded detent pin or ball 48 resides in the associated hole in the top surface of the tubular member 26. In the embodiment shown the bracket 24 is secured to the left end of the tubular member by inserting it therein so that the detent snaps into the hole 30 in the tubular member.

The fixture 20, with the container still connected to it is now ready to be mounted on the vertically oriented support structure. To that end in the exemplary embodiment shown herein the container can be lifted by use of the handle formed by the opening 282, i.e., the user can stick his/her hand into that opening as shown in FIG. 6. The container and the fixture can then be carried to the position wherein the ears 52A, 52B and 52C of the bracket's connector 24A are inserted into three immediately adjacent slots at the desired height on the upright 100. The container and the fixture are then pushed inward so that the ears are entirely within the upright 100 and then the bracket is pushed downward, as shown by the heavy line arrow, to bring the undercut portions of the ears into engagement with the portions of the upright contiguous with the bottoms of the slots 102, thereby locking the bracket in place as shown FIG. 7.

If the tear strip 288 had not been previously pulled completely off of the container, it is now done, to free the lower portion of the outer carton of the container. To that end the lower portion of the outer carton is pulled downward in the direction of the heavy arrow in FIG. 7 to expose the garment belts. The remaining portion of the outer carton, i.e., the portion holding the inner compartment can then be removed by merely lifting it upward in the direction of the heavy arrow shown in FIG. 8. This action leaves the fixture mounted on the vertical support structure, with the garment belts totally exposed and easy to view. The cap 36 can then be mounted with the free open end of the tubular member 26. If the fixture includes the heretofore mentioned header for carrying advertising or other indicia it can then be mounted in place on the fixture.

As should be appreciated by those skilled in the art, the container of the subject invention offers various advantages to merchandisers since it allows them to save time and expense of having their personnel fill a fixture with merchandise. Moreover, the container for holding the merchandise also contains a fixture that can be readily mounted on any type of vertical support surface, all the while the merchandise is held on the fixture and is protected by the container. Moreover, each fixture can be mounted on any wall or other vertical surface from either end of its elongated display member using the same bracket, by merely connecting the bracket to whatever end of the elongated display member is desired. The particular bracket chosen for this purpose will depend upon the type of support member the bracket is to engage. This arrangement reduces the cost for the merchandiser, since it eliminates the need keep a supply of left and right handed brackets in inventory. A further advantage of the subject invention is that the fixture can be readily assembled without any tools or special techniques while the merchandise is supported by it and protected by the container. Disassembly of the fixture can also be effected easily, quickly and without the need for any tools or special techniques.

While the invention has been described in detail and with reference to specific examples thereof, it will be apparent to one skilled in the art that various changes and modifications can be made therein without departing from the spirit and scope thereof.

What is claimed is:

1. An assembly for transporting, storing and merchandising plural suspended articles of merchandise, said assembly comprising a shipping container and a fixture, said fixture and plural articles of merchandise being located in said shipping container, said fixture comprising an elongated display member and a bracket, said elongated display member being arranged to be oriented in a horizontal direction and having a longitudinal axis, a pair of ends and plural hangers from which the articles of merchandise are suspended, said plural hangers being elongated generally linear members fixedly secured to said elongated display member and extending in a horizontal direction perpendicularly to said longitudinal axis, said bracket comprising a first section and a second section, said second section extending at an angle to said first section and including a portion arranged to be oriented in a horizontal direction for releasably connecting said bracket to either one of said ends of said elongated display member, said first section of said bracket including a connector arranged to engage a portion of a vertically oriented structural member to mount said fixture and said container on the vertically oriented structural member so that said elongated display member extends outward from the vertically oriented structural member in a horizontal direction, said container including perforations to enable a portion of said container to be removed from said assembly to uncover both of said ends of said elongated display member, whereupon said portion of said second section of said bracket can be releasably connected to either one of said ends of said elongated display member to mount said fixture on the vertically oriented support member, said container including perforations adjacent at least one other portion of said container, whereupon said at least one other portion of said container can be completely removed from said assembly while said fixture is mounted on the vertically oriented structural member, whereupon the plural articles of merchandise hang downward from said fixture for display.

2. The assembly of claim 1 wherein said shipping container comprises a carton that includes tearable portions to enable the easy removal of said carton from said fixture.

3. The assembly of claim 1 wherein said plural articles of merchandise are grouped on said hangers based on a characteristic of each of said plural articles of merchandise.

4. The assembly of claim 3 wherein said plural articles of merchandise comprise plural garment belts.

5. The assembly of claim 4 wherein said belts are grouped on said hangers based on the size of said belts.

6. The assembly of claim 1 wherein said container comprises a handle to facilitate the lifting of said assembly.

7. The assembly of claim 1 wherein each end of said elongated display member is hollow and arranged to releasably receive said first section of said bracket therein.

8. The assembly of claim 7 wherein said first section of said bracket is arranged to snap fit into each hollow end of said elongated display member.

9. The assembly of claim 8 wherein said elongated display member includes a pair of holes, with one of said holes being adjacent one hollow end of said elongated display member and with the other of said holes being adjacent the other of said hollow ends of said elongated display member, and wherein said second section of said bracket comprises a spring loaded projection arranged to snap fit into either of said holes in said elongated display member when said second section of said bracket is received in one of said hollow ends thereof.

10. The assembly of claim 1 wherein said elongated display member is arranged to mount a panel for carrying advertising or promotional indicia thereon.

11. The assembly of claim 1 wherein each of said hangers comprises an elongated prong extending outward from said elongated display member.

12. A container arranged for holding a fixture, the fixture comprising an elongated display member having a longitudinal axis and plural elongated hangers fixedly secured to the elongated display member and extending perpendicular to the longitudinal axis, each of the plural hangers having a free end, the plural hangers having plural articles of merchandise preloaded thereon, the elongated display member having a pair of ends, said container comprising an outer carton and an inner compartment, said container being formed of a blank of a planar material capable of being folded along plural fold lines to form said outer carton and said inner compartment, said outer carton being a hollow member, said inner compartment having a first wall portion spaced inward from the outer carton and having an opening therein arranged to receive the free ends of the hangers of the elongated display member to support the fixture within said inner compartment and with at least portions of the plural articles of merchandise located within said outer carton, said outer carton comprising a removable first portion defined by a weakened line, said removable first portion being arranged to be removed from said outer carton along said weakened line to provide access to said inner compartment and to expose at least one of the ends of the elongated display member, said container being arranged to be carried to a location having a vertically oriented structural member to mount the fixture on the vertically oriented structural member by the exposed at least one of the ends of the elongated display member with the hangers of the fixture remaining received within said first wall of said inner compartment, a second portion of said outer carton being arranged to be removed from said container to expose the plural articles of merchandise while the fixture is mounted on the vertically oriented structural member, said inner compartment being arranged to be removed from the fixture while the fixture is mounted on the vertically oriented structural member leaving the fixture mounted on the vertically oriented structural member, with the plural articles of merchandise supported by the fixture.

13. The container of claim 12 wherein said outer carton is arranged to be broken to form a flap and a contiguous opening providing access to the interior of said compartment.

14. The container of claim 13 wherein said flap and said contiguous opening serve as a handle for enabling said container to be lifted by said handle.

15. The container of claim 12 wherein said outer carton additionally comprises a handle for enabling said container to be lifted thereby.

16. The container of claim 12 wherein the fixture comprises an elongated display member on which the articles of merchandise are suspended, the display member having a pair of ends and being arranged to be mounted on the vertically oriented structural member by either of the ends of the elongated display member, and wherein said second portion of said outer carton comprises a strip arranged to be removed from said outer carton to provide access to either end of the elongated display member.

17. A method of packaging and storing plural items of merchandise for subsequent display, said method comprising:

(A) providing a shipping container and a fixture, said shipping container holding said fixture, said fixture comprising an elongated display member arranged to be oriented in a horizontal direction and having a longitudinal axis, a pair of ends and plural hangers, each of said plural hangers being an elongated generally linear member having a free end portion, each of said plural hangers being fixedly secured to said elongated display member and projecting in a horizontal direction generally perpendicularly to said longitudinal axis, said container comprising an outer carton having an inner compartment, said outer carton being a hollow member, said inner compartment having at least one wall located spaced inward from said outer carton, said outer carton having a severable portion;

(B) preloading plural articles of merchandise on said hangers of said fixture; and (C) placing said fixture with said preloaded merchandise thereon within said container and coupling said free ends of said hangers to said at least one wall of said inner compartment, whereupon a portion of said fixture is mounted in said inner compartment and with at least portions of said plural articles of merchandise being located within said outer carton, to protect said fixture and said articles of merchandise and enable them to be shipped to a remote location where said severable portion of said outer carton can be removed to expose said fixture to enable said fixture to be mounted on a vertically oriented structural member and then the remainder of said shipping container can be removed, leaving said fixture mounted on said vertically oriented structural member, with the plural articles of merchandise supported by said fixture.

18. The method of claim 17 wherein said elongated display member is arranged to be mounted on said vertically oriented structural member by said at least one end, and wherein the method additionally comprises the steps of:

(D) removing said severable portion of said outer carton to expose the at least one end of said elongated display member;

(E) carrying said shipping container to the location of said vertically oriented support structure;

(F) mounting said elongated display member on said vertically oriented structural member while said elongated display member is supported by said inner compartment of said shipping container; and (G) removing said inner compartment and any portion of said outer carton to leave said fixture mounted on said vertically oriented structural member, with said plural articles of merchandise supported by the fixture.

19. The method of claim 18 wherein said method additionally comprises placing a bracket in said shipping container at the location of said inner compartment, said bracket forming a portion of said fixture, said method additionally comprising removing said bracket from said shipping container and securing said bracket to said at least one end of said elongated display member, and then mounting said bracket on said vertically oriented structural member.

20. The method of claim 19 wherein said vertically oriented structural member comprises any of the group of a conventional slotted upright, a wire rack, a slat wall and a peg board, and wherein said bracket is particularly configured for releasably mounting thereon.

21. The method of claim 17 wherein said method comprises removing said severable portion of said outer carton to expose either of said ends of said elongated display member.

22. The method of claim 17 wherein said severable portion of said outer carton comprises a weakened line arranged to be severed by applying a force thereto.

23. The method of claim 17 wherein said shipping container additionally comprises a handle portion arranged for carrying said shipping container to the location of said vertically oriented structural member.

24. The method of claim 17 wherein said articles of merchandise are suspended from said fixture.

25. The method of claim 17 wherein said articles of merchandise comprise garment belts.

* * * * *